US005192238A

United States Patent [19]

Brown

[11] Patent Number: 5,192,238

[45] Date of Patent: Mar. 9, 1993

[54] SELF-ACTIVATED MAN OVERBOARD RECOVERY SYSTEM

[76] Inventor: John B. Brown, 55860 Breden Rise La., Mishawaka, Ind. 46545

[21] Appl. No.: 918,175

[22] Filed: Jul. 14, 1992

[51] Int. Cl.[5] ..... B63C 9/26

[52] U.S. Cl. ..... 441/84

[58] Field of Search ..... 114/311; 441/80, 83-85, 441/136

[56] References Cited

U.S. PATENT DOCUMENTS

| | | | |
|---|---|---|---|
| 3,696,453 | 10/1972 | Harris et al. | 441/84 |
| 4,343,056 | 8/1982 | McDonald | 441/84 |
| 4,498,879 | 2/1985 | Burr | 441/80 |
| 4,599,073 | 7/1986 | Fryer et al. | 441/80 |
| 4,733,628 | 3/1988 | Baughman | 114/311 |
| 4,766,837 | 8/1988 | Parish | 114/311 |

FOREIGN PATENT DOCUMENTS

| | | | |
|---|---|---|---|
| 1077784 | 5/1980 | Canada . | |
| 2638705 | 5/1990 | France . | |
| 0679481 | 8/1979 | U.S.S.R. | 441/84 |
| 716635 | 10/1954 | United Kingdom . | |
| 2144710 | 3/1985 | United Kingdom | 441/80 |
| 2153336 | 8/1985 | United Kingdom . | |

*Primary Examiner*—Edwin L. Swinehart
*Attorney, Agent, or Firm*—Richard C. Litman

[57] ABSTRACT

A man overboard rescue system including a rescue line trailing from a vessel and a sea anchor pack mounted adjacent the stern of the vessel. A victim tugs on the trailing line to release a sea anchor attached to the other end of the line which causes the victim to be towed back to the vessel due to differential drag between the sea anchor and victim. The line is reeved through a one way pulley to assure the victim is towed back to the vessel. Various victim safety harnesses and alarm signal arrangements in conjunction with the system are disclosed. A spooler or storage packs may be provided for stowage of line. A line latch or brake prevents the accidental deployment of the sea anchor in heavy seas. An otherwise conventional line launcher is used when trailing a line from the vessel is impractical.

24 Claims, 7 Drawing Sheets

SELF-ACTIVATED MAN OVERBOARD RECOVERY SYSTEM

FIELD OF THE INVENTION

The present invention relates to "man overboard" rescue and retrieval systems and, more particularly, to a person-in-water activated retrieval system requiring no on board crew participation to activate the system.

DESCRIPTION OF THE PRIOR ART

Various man overboard (or MOB) rescue systems are well known. However, a major disadvantage of all prior art MOB rescue systems is that they require active participation of one or more persons or crew members on board a vessel underway to effect rescue and retrieval of the person overboard, by deploying a rescue line and/or float to secure the victim who fell into the water and haul the person back to the vessel. The disadvantages and dangerous nature of such prior art devices are virtually self evident. First and foremost, if no one on board notices that a person has fallen overboard or only notices the accident well after it has occurred, then the chances of effecting a successful rescue are reduced to nil. Secondly, almost all such devices, specifically, those which are more sophisticated than a ring buoy and line tossed to the MOB, are of complicated and thus untrustworthy construction or require a series of complex maneuvers by the vessel underway, particularly if the vessel is under sail, to effect a rescue of the MOB. Thirdly, prior art devices require active participation of one or, more likely, several strong, agile crew members on board to haul the victim back onto the vessel, a particularly difficult and even dangerous operation when seas are heavy and/or if the vessel has any considerable freeboard. Conversely, the present invention provides a davit or hoist apparatus operable by the victim alone to assure his or her complete recovery back on board. Furthermore, in the event the hoist or davit option is not chosen, simple reboarding may be accomplished by utilizing a swim ladder or swim platform, on vessels so equipped.

The following prior art domestic and foreign patents are representative of known rescue systems for persons overboard. For example, French Patent No. 2,638,705, filed by Daniel Wlochowski and published Mar. 11, 1990, teaches a man overboard rescue system requiring a victim attached radio transmitter to activate the opening of a vessel carried pack to deploy free floating rescue gear, unattached to the vessel, to which the victim swims. The deployed rescue gear carries another gear location signal transmitter requiring a crew member to monitor rescue gear location with a hand held receiver. Clearly, a successful rescue with this system is impossible without the active participation of one or more crew members on board a vessel.

U.S. Pat. No. 4,599,073 issued Jul. 8, 1986 to Douglas M. Fryer et al teaches a man overboard rescue system requiring a crew member to stop the vessel, deploy a flotation sling on a floating tether line attached to the vessel, and then circle the vessel about the person overboard in decreasing concentric circle fashion to effect a successful rescue. This system also cannot be used to accomplish a rescue without the active notice and participation of one or more crew members on board the vessel from which the victim fell. A somewhat similar system including a line reeved through a shroud mounted boom to a deck mounted winch is taught in U.S. Pat. No. 4,343,056, issued Aug. 10, 1982 to Charles D. McDonald. Again, a person overboard cannot be rescued without participation by a crew member on board the vessel both to deploy the rescue line from a canister and winch the floating victim back to the vessel.

Another free floating rescue gear system is seen in U.S. Pat. No. 3,696,453, issued Oct. 10, 1972 to John L. Harris, et al. The gear includes a deployed drogue chute, but its purpose is solely to keep the rescue gear from being dragged in the wake of a vessel. The system is unattached to the vessel from which it is deployed and requires the active participation of one or more crew members on board to carry out a successful rescue. A similar, free floating rescue gear system is seen in U.S. Pat. No. 4,498,879, issued Feb. 12, 1985 to J. Kelsey Burr, the system including automatically inflated gear and a visible signaling lamp which is observed by a person on the vessel; obviously, active crew participation is required to rescue the victim from the water.

The following patents are related to some of the details of the instant invention. The sea anchor of this invention, used to haul the victim back to a vessel underway is not new per se; examples of recoverable sea anchors are shown in U.S. Pat. No. 4,733,628, issued Mar. 29, 1988 to Joseph W. Baughman and U.S. Pat. No. 4,766,837, issued Aug. 30, 1988 to James M. Parish. A container for rescue gear including a spring opened container held normally closed by a pin which is pulled free by a crew member on deck is seen in Canadian Patent No. 1,077,784, issued May 20, 1980 to David A. Plaunt. Deck mounted davits or hoists for lifting a victim from the water back onto a vessel are disclosed in British Patent No. 716,635, issued Oct. 13, 1854 to Otto Schuchmacher and U.K. Patent Application No. 2,153,336A, filed by John R. Stammers and published Aug. 21, 1985.

None of the above inventions and patents, taken either singly or in combination, is seen to describe the instant invention as herein disclosed and claimed.

SUMMARY OF THE INVENTION

Accordingly, it is a principal object of the invention to provide a person overboard activated retrieval system which is activated solely by the person overboard and requires no intervention by crew remaining on board a vessel underway.

It is another object of the invention to provide a person overboard retrieval system activated by the victim grasping a line trailing a vessel underway, which releases a sea anchor or drag chute into the water and pulls the victim back to the vessel.

It is a further object of the invention to provide a person overboard retrieval system including a hand held, person equipped line latching and locking device which, when latched onto a trailing line from a vessel underway, causes a sea anchor to deploy and haul the victim back to the vessel underway.

Still a further object of the invention is to provide a person overboard activated retrieval system including a trailing line reeved through a one way pulley assembly to a drag chute or sea anchor normally housed in a container, which sea anchor is automatically deployed upon the victim grasping the trailing line, thus to haul the victim back to the vessel underway without need of any intervention or assistance from crew on board the vessel.

It is an object of the invention to provide a person overboard activated retrieval system which is automatically actuated by the victim upon grasping a line trailing in water from a vessel underway, not only to haul or tow the victim back to the vessel but also to automatically lift the victim from the water, back onto the vessel deck without need of assistance from crew on board the vessel.

Yet a further object of the invention is to provide a person overboard activated retrieval system including a line trailing in water and grasped by a victim, thus to cause the victim to be towed back to the vessel underway and, simultaneously, actuate an alarm, turn on an aft directed spotlight, and/or interrupt fuel flow to the engine of a vessel underway so equipped, without need of assistance from crew on board the vessel underway.

A still further object of the invention is to provide a person overboard retrieval system including a trailing line grasped by a victim to deploy a sea anchor or drag chute, the sea anchor being normally housed in a container which is adjustably mounted in at least two attitudes to facilitate repacking of the sea anchor after use.

It is another object of the invention to provide a person overboard activated retrieval system including a line trailing from a vessel underway and a hand held, line latching and locking device including multiple, open slots through which a segment of the trailing line is laced by the victim, thus assuring secure grasping of the trailing rescue line by the victim.

It is yet an additional object of the invention to provide a person overboard activated retrieval system including a line trailing from a vessel underway, and a line stowage system or assembly for stowage of the trailing line while the trailing line is not in use.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
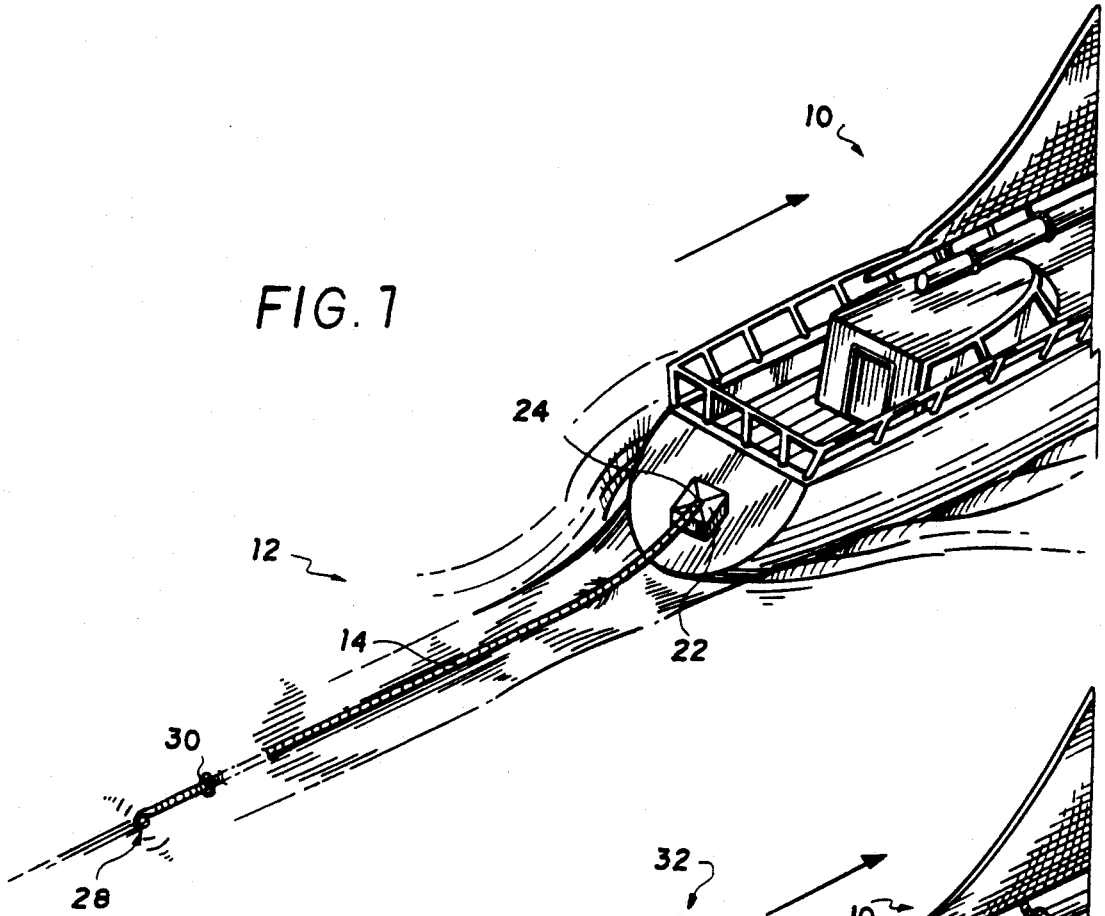
FIG. 1 is a perspective view of a vessel underway with the trailing line of the invention being deployed in water behind the vessel.
Figure 2:
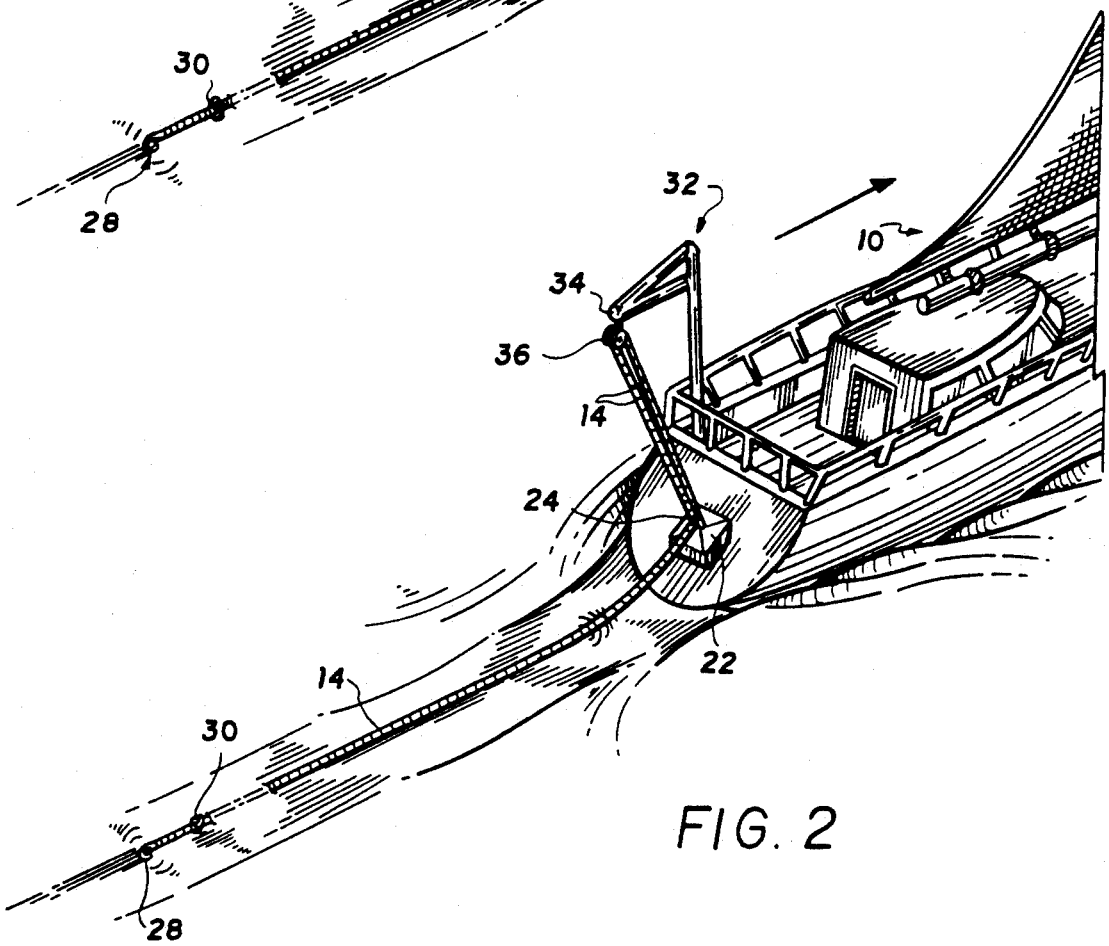
FIG. 2 is a view similar to FIG. 1 but showing a second embodiment of the invention, including a davit or hoist at the stern area of the vessel underway.
Figure 3:
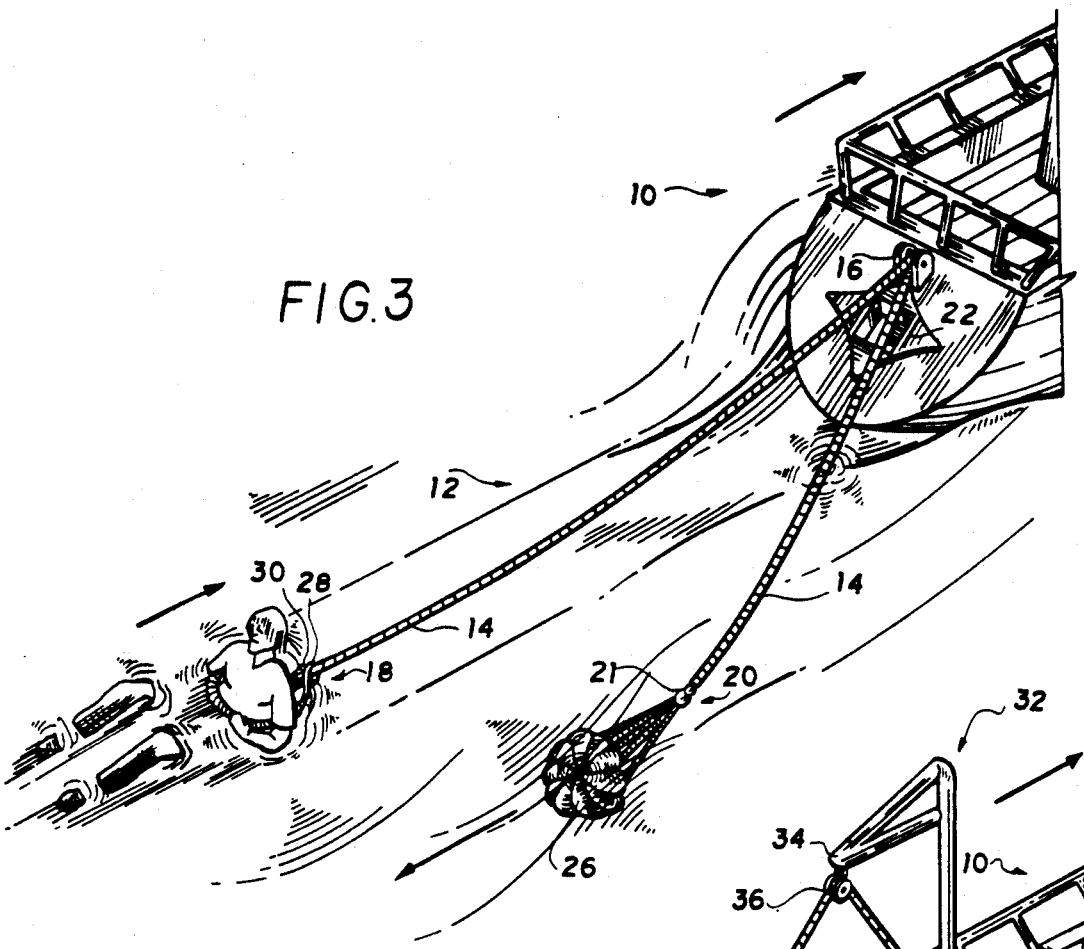
FIG. 3 is a perspective view of the embodiment of the invention as shown in FIG. 1, the trailing line having been grasped by a person overboard and the sea anchor deployed.
Figure 4:
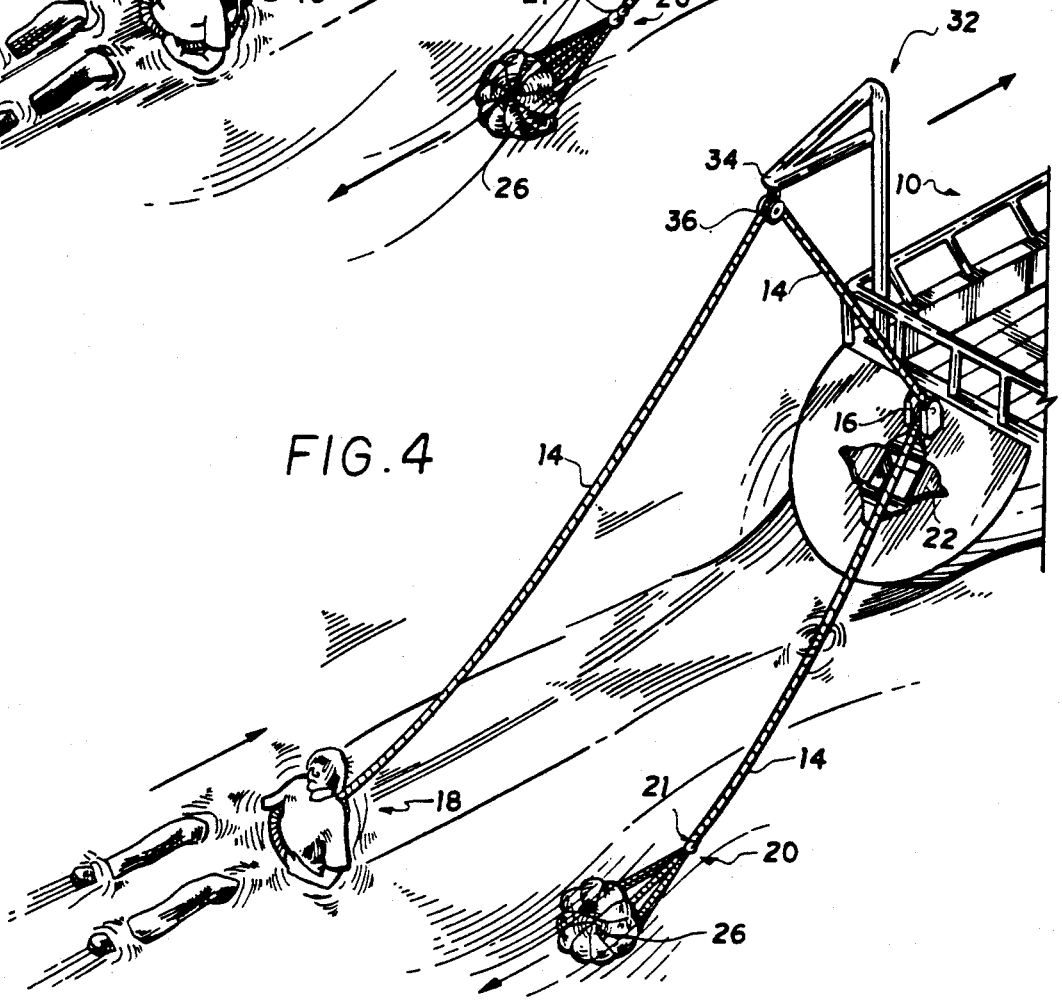
FIG. 4 is a view similar to FIG. 3, but showing the embodiment of the invention illustrated in FIG. 2, the trailing line having been grasped by a person overboard and the sea anchor deployed.

Referring now to the drawings by reference character and, in particular, to FIGS. 1 and 3 thereof, a first embodiment 12 of the rescue system invention is shown ready for use, with a line 14 trailing in water behind a vessel underway 10. Line 14 is made of a floating material, such as polypropylene, and is of a predetermined length of, for example, from 50 to 300 feet, and even 500 feet or more, should circumstances warrant. For example, the greater the speed of the vessel underway 10, the longer the trailing line 14 will be, ordinarily. Deployment of the trailing line 14 will be at the skipper's discretion and is usually done while sailing or motoring in open water and not in the relatively close confines of a harbor. Line 14 is reeved through a one way pulley 16 and includes a distal end 18, at the end of the line 14 trailing in water, and a proximal end 20, secured to a sea anchor 26, as shown in FIG. 3. Line proximal end 20 and sea anchor 26 are interconnected by a swivel attachment 21, to reduce any tendency of twisting in the line 14. The sea anchor is normally housed in a container 22, affixed to a transom of the vessel 10, in this particular embodiment. Additionally, the one way pulley 16 is also housed within container 22, as seen in FIGS. 1 and 2, which is preferred. On the other hand, pulley 16 may be located externally of the container 22, as is illustrated in FIGS. 3 and 4. Additional arrangements of container 22 and pulley 16 are discussed hereinbelow.

A portion 24 of line 14 between the distal end 18 and the one way pulley 16 is operatively associated with either the container 22 or the sea anchor 26 as described below. Once a person falls overboard, all he or she has to do is swim a short distance laterally of the direction of travel of the vessel 10 and either grasp the line 14 by hand or by use of a line latch or lock to be described later, or simply allow the line 14 to trail between the hands until the end 18 is reached. The end 18 of line 14 includes a simple snap hook 28 and a snap hook stop, which may be a simple knot 30, formed in line 14 a distance from snap hook 28 in this particular embodiment; additional embodiments are described below and illustrated in FIG. 18. The distance between knot 30 and snap hook 28 is of a sufficient length so as to comfortably encircle the torso of a person overboard. The person in water simply grasps the snap hook area of line 14, circles the line about the upper chest, and engages the snap hook forwardly of knot 30 so that the line 14 is prevented from encircling the torso of the person overboard too tightly.

In any event, whether the snap hook is used as just set forth, or a line latch is used, or the person overboard simply grabs the trailing line 14, tension will be exerted on the line 14 between the person overboard and the openable closures of container 22. This applied tension causes the container 22 to be opened and the sea anchor 26 to be deployed in the water behind vessel 10, there being a sufficient length of line 14 stored in the container to permit the sea anchor 26 to fall free. The result is clearly illustrated in FIG. 3. Up to this point, it will be readily appreciated that absolutely no intervention by or assistance from one or more crew members on board the vessel 10 was required to secure the person overboard and initiate a safe tow of the person back to the vessel.

Figure 23:
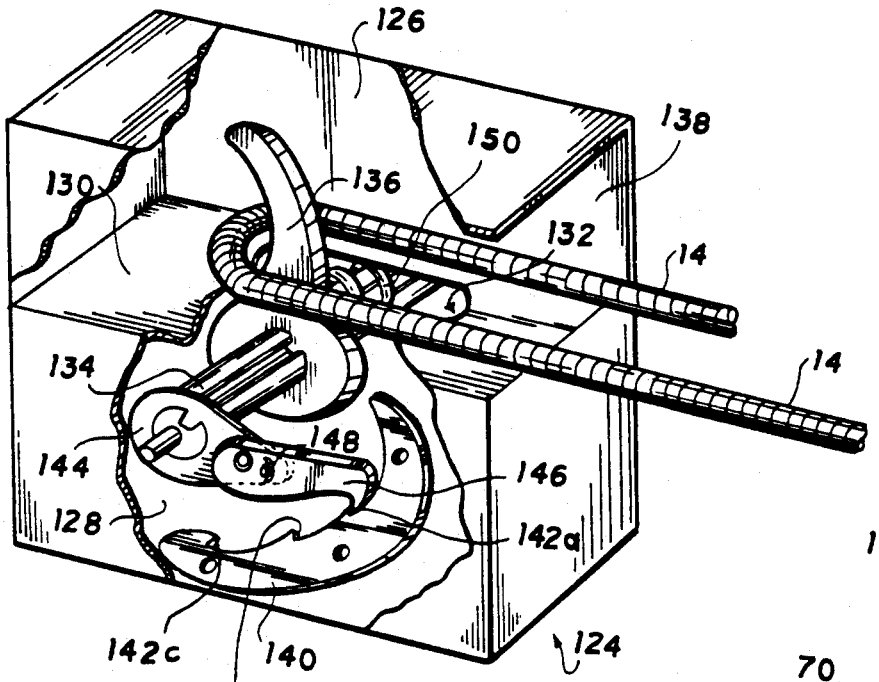
FIG. 23 is a front perspective view of the line latching mechanism illustrated in FIG. 22, with parts broken away to reveal interior detail, and drawn to an enlarged scale.
Figure 22:
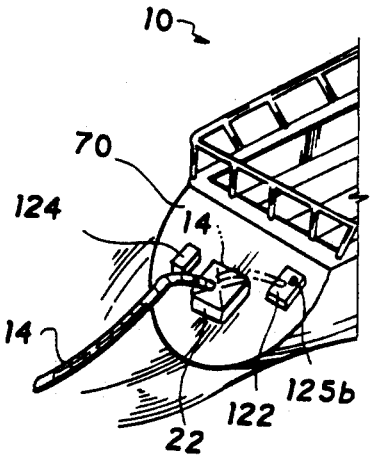
FIG. 22 is a partial perspective view similar to FIG. 1 but showing a line latching mechanism for preventing accidental deployment of the sea anchor of the invention, to the left of the figure, and an optional line launching device, to the right of the figure.
Figure 24:
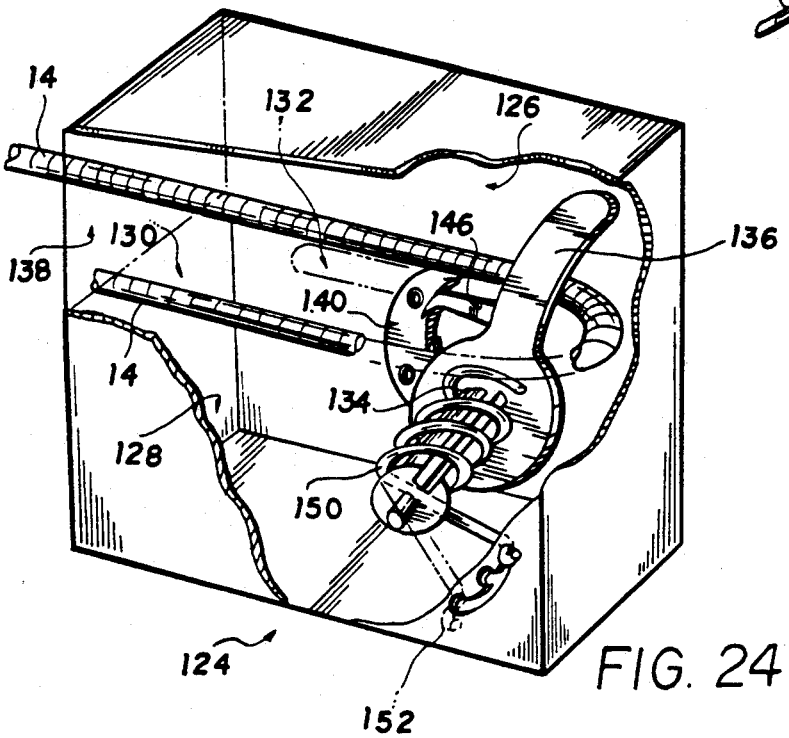
FIG. 24 is a rear perspective view of the line latching mechanism shown in FIG. 23, with parts broken away to reveal interior detail.

Since it is possible for large waves and snagged objects to accidentally activate the recovery system of this invention, it is desirable to have a line brake or latch mechanism interposed between the container 22 and trailing line distal end 18 in order to prevent inadvertent deployment of the invention. One such suitable line brake or latch is illustrated in FIGS. 22-24 and discussed in more detail hereinbelow. A principal feature of this line brake or latch is that container 22 is prevented from opening and sea anchor 26 will not be deployed until the person overboard exerts three distinct pulls on the trailing line 14, which then causes the line to separate from the line brake or latch mechanism and allow container 22 to open and sea anchor 26 to be deployed. The line brake or latch is designed so that a strong, single pull or even double pulls exerted on the trailing line 14 by wave action can be absorbed, thus preventing accidental opening of container 22 and inadvertent deployment of the sea anchor 26. It is also possible to have a line brake or latch mechanism which is remotely released by a waterproof radio transmitter carried by the person overboard, which would activate a receiver to release the line brake or latch mechanism.

Now, with the line 14 free of container 22 and sea anchor 26 deployed, the vessel 10 continuing to move relative to and thus away from sea anchor 26, the line 14 trailing behind the vessel and one way pulley 16 with the person overboard is caused to pull the person overboard back to vessel 10, due to the relative drag differential between the sea anchor 26 and the person overboard being towed; clearly, the drag coefficient of the sea anchor 26 is far greater. Thus, the sea anchor is relatively stationary as vessel 10 continues to move away from sea anchor 26, thus causing the person overboard to be hauled back to the vessel due to the differential drag. The one way action of pulley 16, which permits line 14 to travel therethrough only in the direction of line 14 proximal end 20 which is attached to sea anchor 26, is vital if a hoist (discussed in detail below) is used. The one way construction of pulley 16 allows the person overboard to be hoisted from the water without a yo-yo effect. Of course, the invention will also operate for its intended purpose without the one way pulley action described, but it would not be safe to hoist the person overboard from the water without the one way pulley 16.

In the particular embodiment under discussion, one way pulley 16 need only be constructed so as to permit travel of line 14 therethrough in a direction toward the sea anchor 26. However, and if found desirable, pulley 16 may be of otherwise conventional, true one way construction, and include an internal ratchet and pawl construction so that movement of line 14 therethrough is assured to be only in a direction toward sea anchor 26. Furthermore, one way pulley 16 may include an internal overload release, if desired. More specifically, if drag sensed is above a preset threshold limit, as could occur if the person overboard were hauled into some flotsam, then the one way action of pulley 16 would be released so as not to cause possible injury to the person being towed back to vessel 10. Thus, as used in the appended claims, the term "one way pulley" should be interpreted to include an otherwise conventional overload release as just described.

As can be seen from both FIGS. 3 and 4, the person overboard should turn himself so that his or her back faces the stern of the vessel 10 during the retrieval operation, once the person has latched onto the trailing line 14. This assures that the wake created by the person as he or she is being towed back to the vessel will not be in the person's face, possibly causing accidental inhalation of water or even drowning. The desired turning action is almost natural and can be taught to all crew members in a very short time period.

A second embodiment of the invention is illustrated in FIGS. 2 and 4, including the essential components of the embodiment of FIGS. 1 and 3, with the addition of a pivoting hoist or davit 32 of generally inverted, braced L configuration as shown, for strength of assembly and economy in manufacturing costs; other configurations for hoist 32 are possible, of course. The outboard end 34 of hoist 32 is equipped with an additional pulley 36 through which line 14 is reeved. As can be readily seen in FIGS. 2 and 4, trailing line 14 passes from the openable closures of container 22 to pulley 36, thence to pulley 16, mounted generally centrally of the stern of vessel 10 in this embodiment, and to proximal end 20 and sea anchor 26. Of course, container 22 may be mounted in any one of a variety of positions to best suit the specific boat or ship upon which it is mounted. As shown in FIG. 4, when a person overboard grasps trailing line 14 to deploy sea anchor 26 as previously described, sea anchor 26 permits vessel underway 10 to tow the person overboard back to the vessel.

Figures 5, 6, 7:
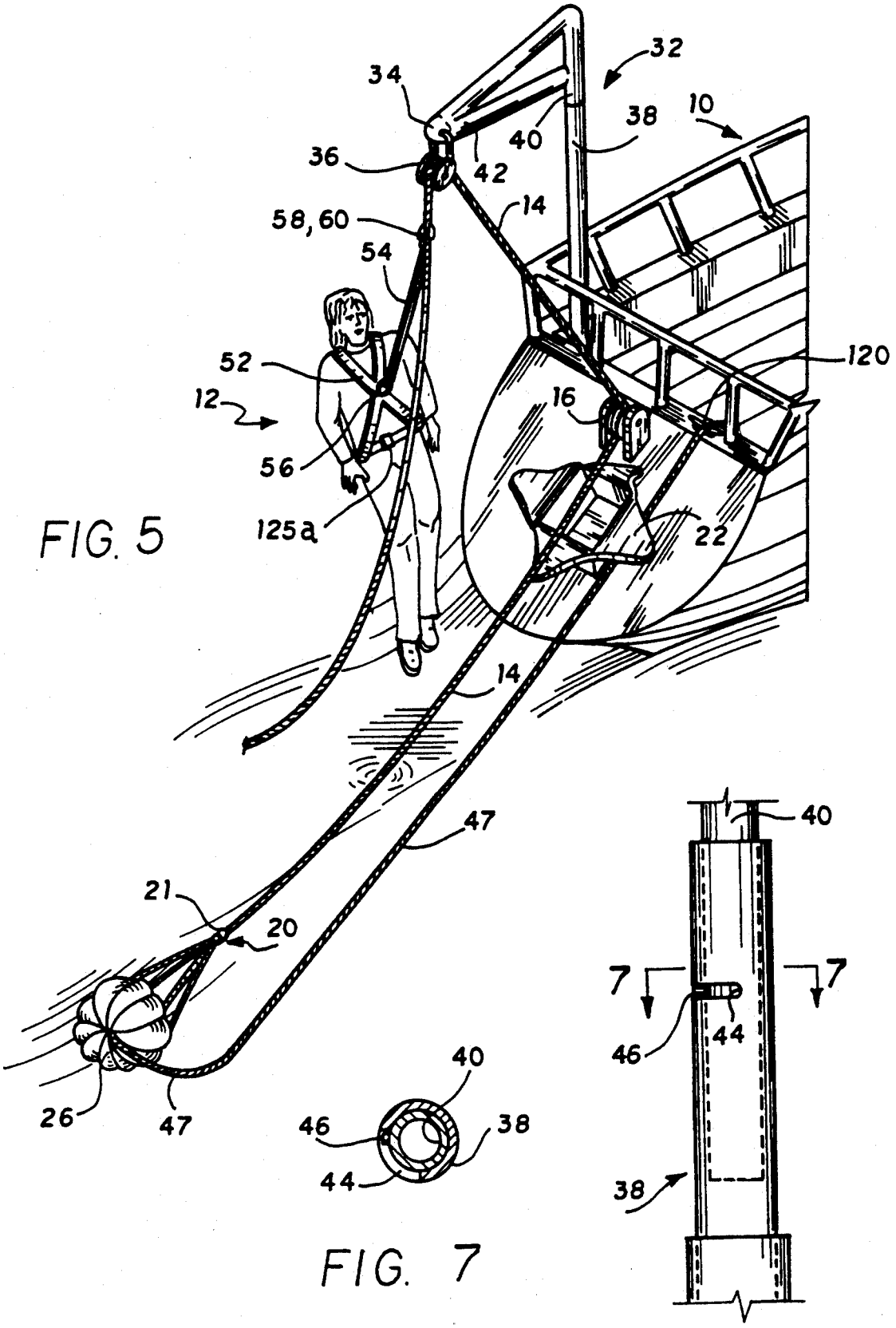
FIG. 5 is a perspective view of the embodiment of the invention shown in FIG. 2, the person overboard having been brought back to the vessel underway and lifted from the water by use of a line latching member of a type shown in FIGS. 10 and 11.
FIG. 6 is a partial, side elevational view of a hoist mast, showing structural detail allowing pivoting of the upper portion of the mast.
FIG. 7 is a sectional view, drawn along lines 7—7 of FIG. 6.

Referring now to FIG. 5, it is seen that the second embodiment of the invention not only permits towing of the person in water back to the vessel but also accomplishes lifting of the person completely clear of the water. Furthermore, due to the offset arrangement of pulley 36 on hoist end 34 with respect to pulley 16, and the pivoting construction of hoist mast 38, as explained below, when the knot 30 engages pulley 36, or when a line latching device carried by the person engages pulley 36, hoist 32 is caused to pivot toward the stern of vessel 10, due to the relative, parting movement of sea anchor 26 with respect to vessel 10. Thus, the rescue or retrieval operation is completed, with the person returned to the deck of the vessel, without need of assistance from any crew members on board. Of course, the rescue system of this invention is of particular value when one is solo sailing, or standing watch by oneself while others sleep below.

In this embodiment of the invention, it is important that at least one if not both of the pulleys 16, 36 be of true one way construction, so as to assure that the full weight of the person retrieved is carried by hoist 32. Of course, the weight of the person will be considerably greater than the drag force the person presents while being towed back. Alternatively, sea anchor 26 could be of sufficient capacity to cause lifting of the person from the water. Should vessel 10 slow or become dead in the water, and the sea anchor has passed the person overboard, the person being retrieved can grasp that portion of the trailing line between the vessel and the sea anchor and easily pull himself back to the vessel. If the sea anchor has not passed the person overboard, the line to which he is attached may be used in hand over hand fashion to accomplish self resue, due to the one way construction of pulley 16. Thus, the present invention provides for unexpected, additional methods of self rescue, especially when compared and contrasted to prior art methods inherent in the prior art discussed above.

Turning now to FIGS. 6 and 7, a construction of the mast of hoist 32 is illustrated which allows the conclusion of the retrieval operation of the person overboard without need of assistance of any on board crew members. The mast includes a central, tubular section 38 into which an upper mast portion 40 is telescopically and rotatably interfitted. Mast portion 40 carries boom 42 with pulley 36 at the end thereof. A 90 degree slot 44 formed through section 38 cooperates with a retaining pin 46 on mast portion 40, the pin and slot assembly defining the limits of rotation of mast portion 40 with respect to mast section 38. Slot 44 is shown being of one quarter or 90 degree extent but could extend farther if desired. The point is that the arrangement assures that hoist boom 42 with end 34 and pulley 36 are directed astern as the person overboard is being towed back to the vessel 10. Once the person is lifted from the water as seen in FIG. 5, with either knot 30 (see FIG. 2) or a line latching and locking member (see FIGS. 10 and 11) abutting against pulley 36 on mast boom 42, further travel of line 14 through pulley 36 stops. With continued forward movement of vessel 10, sufficient tension is now exerted on the portion of line 14 between pulley 36 through pulley 16 and sea anchor 26 to cause mast section 40 and boom 42 to swivel or pivot toward the stern of vessel 10, because of the just described slot 44 and pin 46 structure. The person overboard is now adjacent the stern of the vessel, whereupon, alone or assisted, he may detach himself from the line 14, and then deactivate and retrieve the sea anchor, as by a tug on an otherwise conventional trip line 47, as shown in FIG. 5, thus completing the retrieval operation. A tug on tripline 47 deflates the chute because tripline 47 is connected to the crown of sea anchor 26. With further reference to the slot 44 and pin 46 arrangement, the slot should extend through about (or slightly less than) a quarter turn to assure that the person being retrieved is returned to the vessel stern area but not against it, so as to avoid injury which could be caused by up and down movement of the stern, particularly in moderate or heavy seas.

Figure 8:
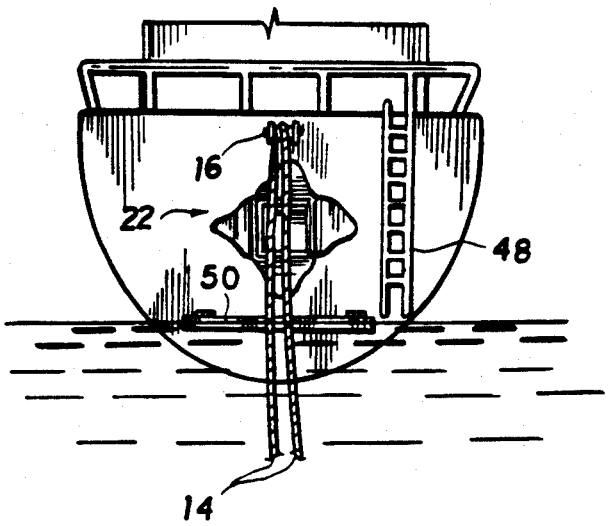
FIG. 8 is a rear elevation view of a vessel equipped with the invention and otherwise conventional swim ladder and platform structures which the person overboard may use to reboard the vessel after being towed back to the stern.

Turning to FIG. 8, and with further reference to the FIGS. 1 and 3 embodiment of the invention, the person being retrieved may employ a conventional swim ladder 48 or a water level platform 50 in order to complete the rescue operation. These two structures are conventional and one or the other or both may be provided on the stern of vessel 10.

Figure 9:
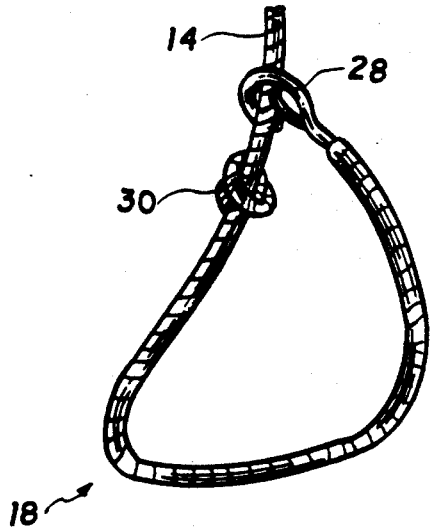
FIG. 9 is a top view showing the very end of the line trailing in water behind the vessel, including a snap hook and a knot formed in the line.
Figure 10:
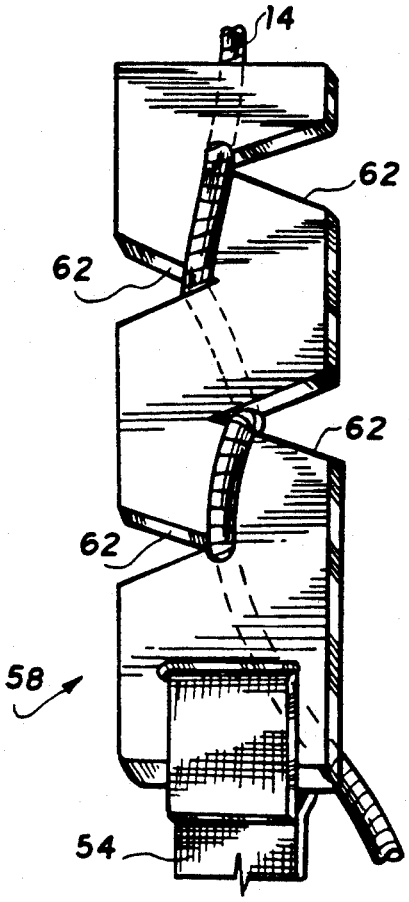
FIG. 10 is a top plan and partially perspective view of a line latching and locking member used by the person overboard to secure himself to the trailing line and initiate a self rescue operation.
Figure 11:
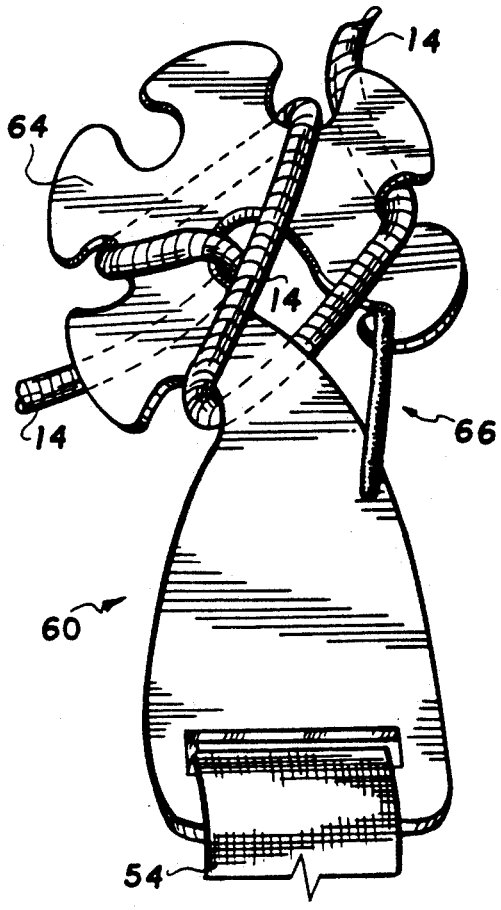
FIG. 11 is a top plan and partially perspective view, similar to FIG. 10, but illustrating another embodiment of a line latching member.

As discussed generally above, the person overboard swims to the trailing line 14 and either graps the line at an intermediate portion or waits until distal end 18 with snap hook 28 and knot 30 come into reach; this trailing end of line 14 is shown in FIG. 9. This structure is particularly useful when the person overboard is not equipped with a line latching device, for example, as shown in FIGS. 10 and 11, and the additional, optional body harness shown in FIG. 5. Should the person attempt to grasp the line 14 passing by him, the line may cause discomfort or slight burning of the hands. With the FIG. 3 arrangement, all the person need do is grasp a part of line distal end 18, encircle the same about his body, and engage snap hook 28 onto line 14 above knot 30. The reason for the knot is to prevent uncomfortable and perhaps injury causing tightening of the line about the person's torso as he is towed back to the vessel.

Figure 18:
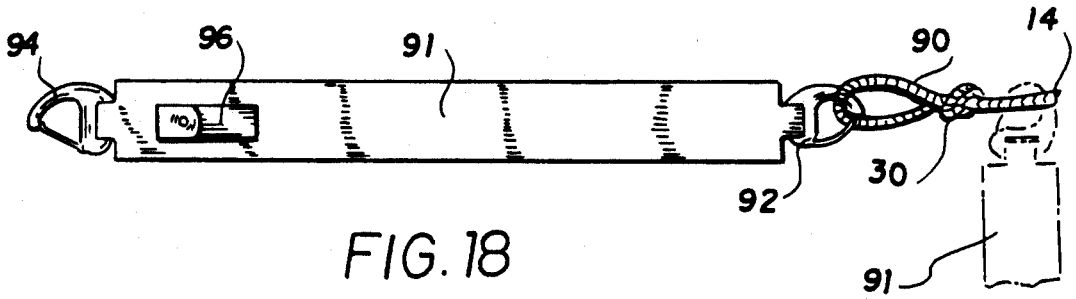
FIG. 18 is an elevational view of a PFD which may be attached to the end of the line trailing in water behind a vessel underway.

FIG. 18 illustrates a preferred, more elaborate design for the trailing end of line 14. A loop 90 is formed by a bowline knot 30, to which is attached a waist style PFD (personal floatation device) 91 by a first snap hook 92. The person overboard simply encircles his body with PFD 91 and latches a trailing snap hook 94 onto line 14, ahead of knot 30, as shown in phantom line in FIG. 18. If desired, PFD 91 may include a conventional bladder (not shown) filled by activation of an equally conventional, manually activated carbon dioxide cartridge housed at 96. In yet another but less preferred embodiment, PFD 91 could be replaced by a simple length of stout webbing, between the hooks 92, 94.

Referring now to FIGS. 5, 10 and 11, preferably crew members will be equipped not only with a PFD (personal floatation device) but also with a body harness 52 to which is attached a length of stout webbing 54 by a snap hook 56. Alternatively, the length of webbing might include a hand held lanyard. As seen in FIGS. 10 and 11, the outer end of webbing 54 has a line latching and looking device 58 or 60, as shown in FIGS. 10 and 11, respectively. As for the line lock 58, when the person overboard reaches the trailing line 14, the line is grasped and weaved through a series of opposed open slots 62; this is accomplished very easily and quickly. Line 14 is thus securely latched and locked within the line lock 58, tension is applied to line 14, and the sea anchor is deployed in the manner set forth previously. Line lock 58 has the advantages of being uncomplicated in structure and use and may be formed or cut from any one of a wide variety of stock materials. Line lock 60, shown in FIG. 11, is similar in function but includes a circular, slotted end 64, through which the line 14 is weaved after initially being snapped into a spring latched lock slot 66. The precise weaving pattern of line 14 through circular end 64 as shown in FIG. 11 is simply one of many that will suffice to latch line lock 60 to line 14. Furthermore, line lock 60 has the advantage of being useful for any person on deck, because the wearer may latch line lock 60 onto a safety line on board so as to prevent the wearer from going overboard in the first place.

Figure 12:
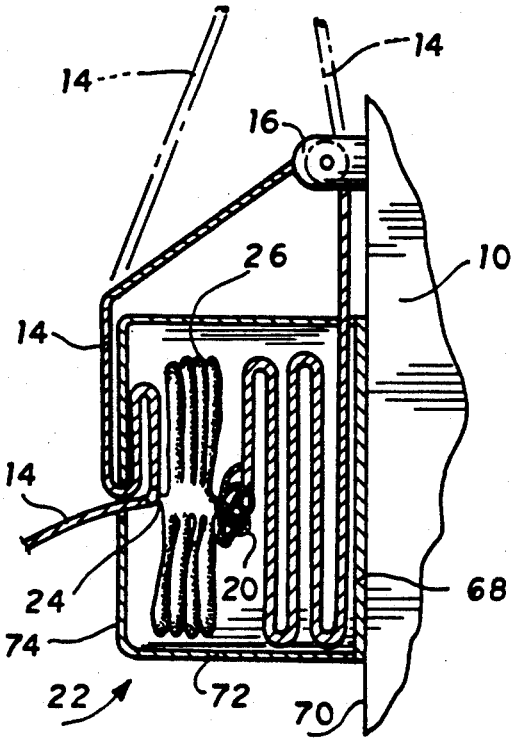
FIG. 12 is an elevational, sectional view showing a container or pack housing a sea anchor, mounted on the transom of a vessel.

Several embodiments for the container 22 housing the sea anchor 26 when not in use are contemplated by the present invention. For example, container 22 is illustrated in FIG. 12 as including a mounting backing 68 of suitable material affixed to transom 70 of a vessel 10 by screws or other suitable fasteners (not shown). Body 72 of container or pack 22 may be made of a flexible material and include a four flap, envelope style closure 74 on the face thereof, the open flaps when opened to deploy the sea anchor 26 being seen in FIGS. 3 and 4. Portion 24 of line 14 may be operatively attached to the crown of sea anchor 26 by a male-female snap connector, hook and loop fastener or other quick disconnect fasteners deemed suitable. In the embodiment shown in FIG. 12, line portion 24 is attached directly to sea anchor 26 to assure deployment after tension is applied to line 24 by a person overboard, and sufficient slack in line 14 within pack 22 is provided as shown to assure that the sea anchor 26 is pulled clear of container 22 when tension is applied to line 14. Should the sea anchor 26 be of the known, spring loaded type, then line portion 24 could simply be attached to the four flap closure 74; opening of the closure 74 alone would permit a spring loaded sea anchor to pop open and properly deploy. In either case, sufficient coiled slack in line 14 is provided in container 22 behind the stowed sea anchor and line proximal end 20 to assure that the sea anchor will fall into the water when deployed as aforesaid.

Figure 17:
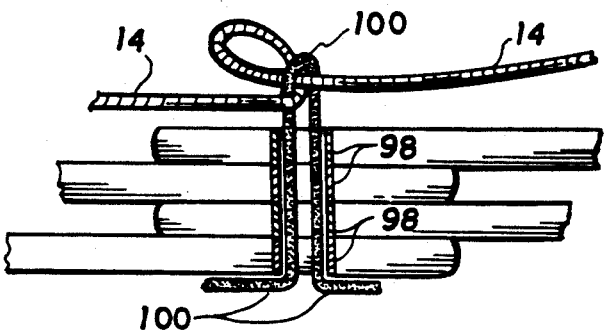
FIG. 17 is a fragmentary, enlarged scale, sectional view of one embodiment of securing a sea anchor pack, ready for opening and deployment of the sea anchor by a person overboard.

As seen in FIG. 17, the free, tongue ends of closure 22 may be provided with grommets 98, through which an elastic cord 100, e.g., a bungie cord, is threaded. The cord 100 is secured to the lowermost flap and line 14 is looped through the extended, upper portion loop of cord 100, as shown. When this closure is used, preferably sea anchor 26 is of a conventional, spring loaded variety so that with the container 22 opened, sea anchor 26 automatically deploys and opens by virtue of its internal, spring loaded construction. Other materials may be used to make the elastic cord 100; ordinary bungie cord materials are susceptible to rapid deterioration in a marine environment. Suitable, rust resistant spring steel material could be used and several other, memory retaining, stretchable materials are well known to those skilled in that particular art.

Figure 13:
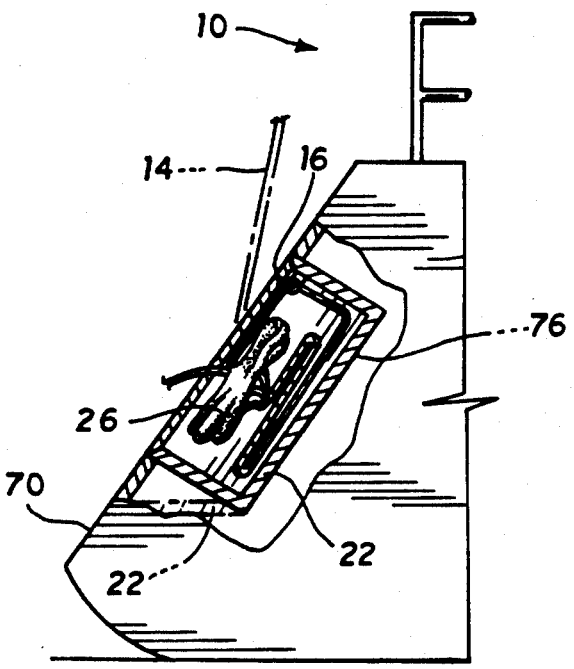
FIG. 13 is a view similar to FIG. 12 but showing a sea anchor pack recessed within the transom of a vessel.

As illustrated in FIG. 13, the entire container 22 and even pulley 16 may be encased within transom 70 of vessel 10 by provision of a receptacle 76 formed within transom 70. This structure can also be used with the embodiment of the invention including a hoist 32, shown in FIGS. 2 and 4–5.

Figure 14:
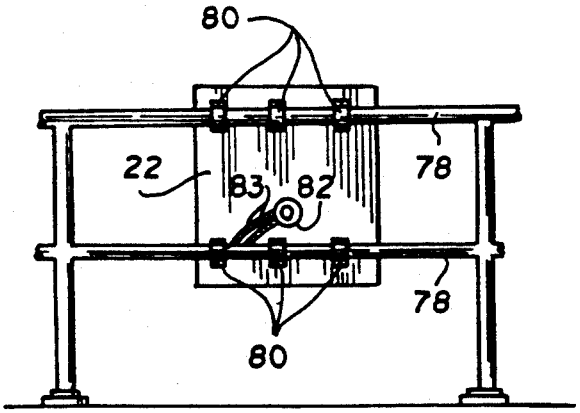
FIG. 14 is a partial elevational view showing mounting of a sea anchor pack on the stern railing of a vessel.
Figure 19:
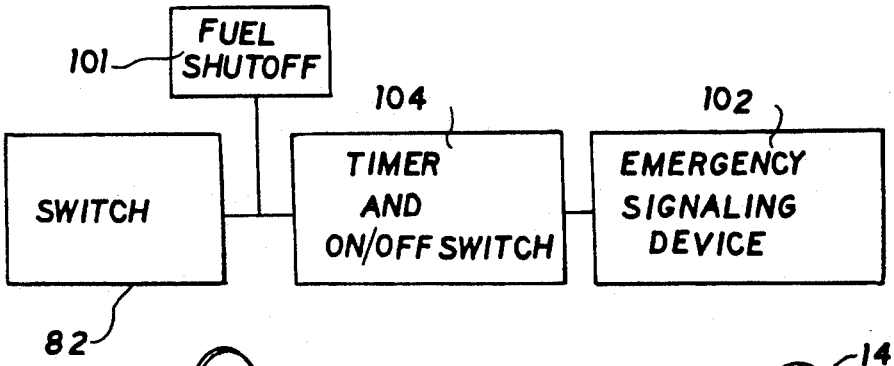
FIG. 19 is a block diagram of a timer controlled emergency signalling system useful with the system.

The container 22 could also be mounted on the guard railing 78 of a vessel as depicted in FIG. 14, by a plurality of U-clamps 80. Ordinarily, pack 22 would be mounted on stern railing, preferably in such a fashion as to be pivotal inboard for repacking after use. This location greatly facilitates the repacking of container 22 after use. Also shown in FIG. 14 is a normally open switch 82 (and connecting wiring 83) which is closed upon activation of the system, to activate an alarm, audible and/or visual, turn on an aft directed spotlight and interrupt fuel flow to a vessel engine, on vessels so equipped, by actuating a fuel shutoff 101, illustrated in FIG. 19. With further reference to FIG. 19, switch 82 could be connected to an emergency signalling device 102 through a timer and manual on-off switch assembly 104. If the switch of assembly 104 is not manually turned off within a predetermined period of time, e.g., 5, 10 or 20 minutes, then device 102 will be activated.

Figure 15:
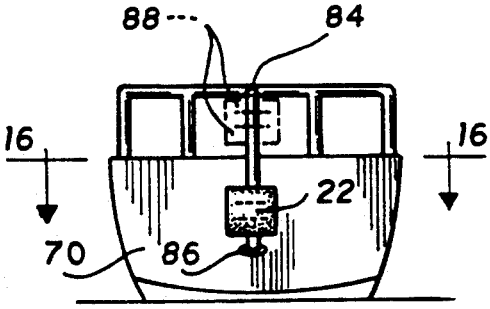
FIG. 15 is an elevational view showing yet another sea anchor pack mounting on the stern of a vessel, an alternative positioning of the pack for ease of repacking a sea anchor therein after use being indicated by phantom lines.
Figure 16:
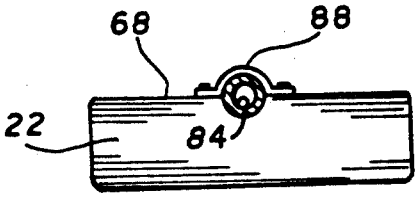
FIG. 16 is a sectional view taken along lines 16—16 of FIG. 15.

Another possible mounting of a container or pack 22 is seen in FIGS. 15 and 16. An extended length pole or pulpit 84 is located on transom 70 and suitably braced at 86. Container 22 is attached to pole 84 by two or more brackets 88 and the container rear or back 68 may be externally grooved or channeled as seen in FIG. 16 to accept the pole 84. After use, and as can be seen in FIG. 15, container 22 may be raised along pole 84 and then rotated 180 degrees to greatly facilitate the repacking of a sea anchor therein.

Figure 20:
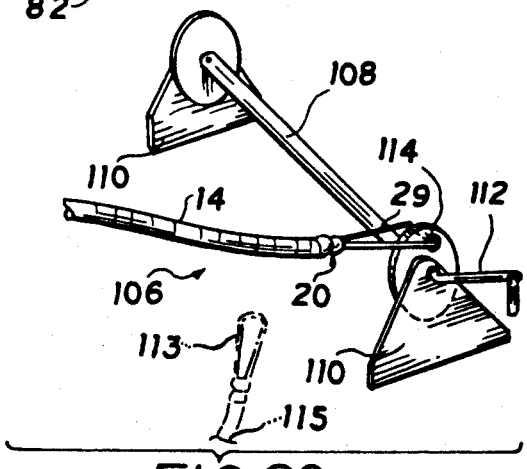
FIG. 20 is perspective, somewhat schematic view of a roller storage system for stowing line when the invention is not actively deployed.
Figure 21:
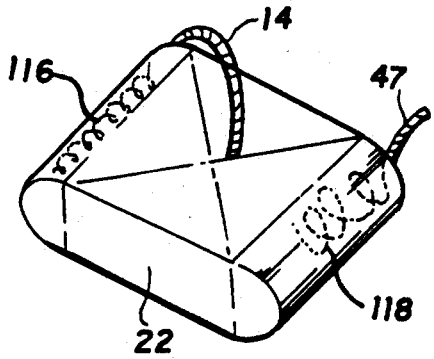
FIG. 21 is a perspective, somewhat schematic view of a sea anchor pack equipped with semicylindrical storage containers for stowage of trailing line and sea anchor trip line when the invention is not actively deployed.

Stowage of line 14 when the invention is not in use, or for unused, excess line 14, is an important consideration. Two convenient yet inexpensive devices for stowage of line are illustrated in FIGS. 20 and 21. In FIG. 20, a line spooler 106 is shown, including a spool 108 rotatably mounted in a pair of bearing blocks 110, 110, which are mounted in a convenient location near the stern of the boat, or on the transom (not shown). The precise location will vary from boat to boat, and need only be conveniently located with easy access to the line 14 portion which normally trails behind the stern when the invention is in use. Spooler 106 may be manually driven and is equipped with a handle 112 for this purpose. Alternatively, spooler 106 could be motor driven (not shown). One end of spool 108 may have a bore 114 formed therethrough to anchor a snap hook 29, adjacent proximal end 20 of line 14, to facilitate the initiation of spooling line 14 onto spooler 106. A secondary snap hook 113 and a short length strap 115 are connected to sea anchor 26, stowed within container 22 (not shown in FIG. 20). Snap hook 113 and strap 115 are shown in phantom lines in FIG. 20. The line 14 is thus easily separated from the sea anchor 26 so that line 14 may be spooled onto spooler 106 for storage, and then reconnected to the sea anchor 26 when the system is deployed for use. After line 14 is payed out, snap hook 29 is detached from bore 114 and rehooked onto snap hook 113, at the end of strap 115, which in turn is attached to sea anchor 26.

In this embodiment of the invention, one way pulley 16 as well as pulley 36 (see FIG. 2), if pulley 36 is also a one way pulley, need to be of two way pulley construction, convertible to a one way action once the system of the invention is deployed. Such pulleys are standard, off-the-shelf items, and form no part of the instant invention per se. This is so that the line 14 may be payed back out through pulley 16 and pulley 36 (in the embodiment of the invention including a hoist 32 as shown in FIG. 2) to deploy the line 14 trailing the vessel. Furthermore, when line 14 is to be spooled onto line spooler 106, the loop through upper portion of cord 100, which holds the flaps of the sea anchor container closed as shown in FIG. 17, is replaced by a short length line of cord or a stick or bar (not shown) in order to retain the container closed when line 14 is stored on the spooler 106. After line 14 is payed out as described above, the short cord or stick or bar is removed from the loop in cord 100 and replaced by the aforesaid loop in line 14, again as shown in FIG. 17.

Another line stowage system is illustrated in FIG. 21. In this case, container 22 (see FIGS. 1–4) is provided with a pair of side mounted, semicylindrical line storage packs 116, 118, for stowage of line 14 as well as trip line 47, respectively. When the invention is in use, and after deployment of sea anchor as shown in FIG. 5, trip line 47 is payed out, and is attached to vessel 10 at a convenient stern cleat 120. For stowage, the respective lines 14 and 47 are coiled and wrapped in conventional fashion and placed within the respective packs 116 and 118.

Turning now to FIGS. 22–24, the line latch or brake mentioned briefly above and an otherwise conventional, U.S. Coast Guard approved line launcher will be discussed. The line launcher 122 may be used for launching the portion of line 14 which, in the embodiments discussed above, normally trails behind vessel 10, as shown in FIGS. 1–4. However, in certain circumstances, e.g., under racing conditions or when navigating in confined waters, it is necessary not to have anything trailing behind the vessel. Under such circumstances, the use of a conventional line launcher 122 is a very practical expedient, in that the safety objects of this invention may be fully met without the need of having the line 14 trailing behind the vessel. Again, the line launcher 122 is a standard, commercially available item and, per se, forms no part of the instant invention. For solo use, a remote actuator for line launcher 122 would be necessary. For example, a conventional button operated radio transmitter **125*a* in a waterproof casing or container and carried by the person overboard (see FIG. 5) would be provided, for communication with a receiver/actuator 125*b* at the line launcher 122, to cause the line to be launched upon actuation of transmitter 125*a*** by the person overboard.

With further reference to FIGS. 22–24, a line brake or latch 124 is shown, which intercepts the trailing portion of line 14 between container 22 and the distal end 18, shown in FIG. 1. As seen in FIG. 22, line latch 124 may be mounted on transom 70 of vessel 10, adjacent container 22.

As best seen in FIGS. 23 and 24, the line latch assembly 124 is housed in a box shaped container, divided into two compartments 126 and 128, by an intermediate floor 130, centrally slotted at 132. Floor 130 is provided to protect the working elements of the latch assembly 124 from the environment as well as prevent the entangling of line 14 in the latch assembly working elements. A lock shaft 134 is rotatably mounted in opposed walls of compartment 128 and has a line lock leg 136 secured thereto and projecting upwardly therefrom, through slot 132, into compartment 126. The compartment 126 is open ended, as seen at 138, and line 14 is looped and inserted into compartment 126, over lock leg 136. A three step ratchet and pivoting pawl assembly is provided, as best seen in FIG. 23, which prevents deployment of the sea anchor from its container until three distinct pulls are exerted on line 14. The ratchet and pawl assembly includes an inwardly curved ratchet plate 140, fixed to the interior of a sidewall of compartment 128, the plate having a top, pointed end step and three additional distinct steps **142*a*, 142*b* and 142*c*. The pawl mechanism includes a mounting plate 144, fixed to lock shaft 134, and a pawl 146, pivotally secured to plate 144 and having limits of pivot travel defined by a slot and pin arrangement 148. The operation of the line brake as thus far set forth will now be described. A first pull on line 14 by a person overboard is translated against lock leg 136 and causes pawl 146 to ratchet down from the very top of plate 140 to step 142*a*. A second pull causes the pawl to ratchet farther down, to step 142*b*. A third and final pull causes pawl 146 to contact step 142*c*, with the result that lock leg 136 is now pivoted far to the right, in the sense of FIG. 23, whereupon line 14 is freed from lock leg 136 and the latch assembly 124. Actually, line 14 will be free of lock leg 136 when pawl 146 is somewhere between step 142*b* and step 142*c*. The final step 142*c* is provided only to prevent the pawl 146 from becoming completely disengaged from the ratchet plate 140**.

Security against inadvertent release of line 14 as just described is provided by a recoil spring arrangement in the form of a torsion spring 150, best seen in FIG. 24, having one end fixed in the base of lock leg 136, and its other end received in an arcuate, three position notch slot 152, formed in a sidewall of compartment 128, opposite the mounting of ratchet plate 140. In FIG. 24, an end of recoil spring 150 is shown fixed in the uppermost notch of arcuate slot 152; this would be the appropriate setting for light sea conditions. This recoil spring end may be moved to the intermediate notch of arcuate slot 152 when moderate seas are anticipated, or to the lower notch, when heavy seas are to be encountered. Of course, the drag of line 14 as well as anticipated debris becoming attached to line 14 would be considered in the setting of recoil spring 150.

With the setting of recoil spring 150 properly adjusted and the system of the invention deployed, pawl 146 will be positioned on the very upper tip of plate 140, above step **142*a*. Wave action might cause the pawl 146 to ratchet down to step 142*a* or even 142*b*, but between swells, the recoil action of spring 150 will simply cause pawl 146 to return to its home position, at the upper tip of plate 140. Thus, the line latch assembly automatically and continually resets itself while the vessel is underway, without need of any monitoring at all. The loop in line 14 is retained by the line brake 124 and the sea anchor of the invention will not be inadvertently deployed. Only three distinct pulls by a person overboard will cause the pawl 146 to ratchet down beyond step 142*b*, thus to cause lock leg 136 to be pivoted far enough to release line 14 and allow the sea anchor 26 to be deployed. Of course, more steps than the three plus the final step 142*c* shown and described could be provided, or fewer could be formed on ratchet plate 140**.

In the discussion of line launcher 122 above, the provision of a radio transmitter **125*a* and a receiver/actuator 125*b* for actuating the line launcher 122 was set forth. The same or similar transmitter and receiver/actuator assembly may be used to release line 14 from the line brake 124. For example, a solenoid actuator (not shown) could be provided to deflect lock leg 136 from the erect position shown in FIGS. 23 and 24, thus to cause release of line 14 from line brake 124**. Alternative radio signal operable mechanisms can be provided to accomplish the same result.

It is to be understood that the present invention is not limited to the embodiments described above, but encompasses any and all embodiments within the scope of the following claims.

I claim:

1. A man overboard activated retrieval system to rescue a person in a body of water from a vessel underway, comprising:

a) a length of line trailing in water from tl.e vessel underway and having a free, distal end and a proximal end;

b) pulley means on the vessel and through which said trailing line is reeved, said pulley means arranged such that said trailing line passes through said pulley means and is movable therethrough in a direction toward the vessel and said trailing line proximal end, and oppositely of said free distal end;

c) container means mounted on the vessel adjacent a stern of the vessel, said container means including openable closure means, said trailing line being operatively associated with said closure means at a portion thereof intermediate said trailing line distal end and said pulley means, whereby upon tension being exerted on said trailing line, said closure means are caused to be opened; and d) sea anchor means normally housed within said container means and operatively attached to said trailing line proximal end; whereby upon a person overboard grasping said trailing line, tension is exerted on the portion of said trailing line between the person overboard and said pulley means, thereby causing said closure means to open and said trailing line proximal end and said sea anchor to deploy in the water behind the vessel underway, the person overboard being pulled towards the vessel underway as said sea anchor means moves relative to and thus away from the vessel underway.

2. The invention as claimed in claim 1, wherein said trailing line further comprises a snap hook at said trailing line distal end and snap hook stopping means formed in said trailing line adjacent to and a predetermined distance from said trailing line distal end, whereby a man overboard may grasp said snap hook, wrap a distal portion of said trailing line about his body, and engage said snap hook onto said trailing line forwardly of said stopping means, thus causing tension to be applied to the trailing line and said sea anchor means to deploy.

3. The invention as claimed in claim 1, further comprising hoist means mounted adjacent the stern of the vessel underway, said pulley means being at least two in number, one being mounted on said hoist means, the other being fixed adjacent said container means, at least one of said pulley means being of one way construction such that said trailing line is confined to move therethrough in a direction toward said sea anchor means.

4. The invention as claimed in claim 3, said hoist means being in the general configuration of an inverted L, and further comprising mounting means for said hoist means allowing pivoting of said hoist means in a direction toward the vessel underway to thus facilitate reboarding of the person overboard.

5. The invention as claimed in claim 1, said emergency rescue system further comprising harness means for wearing by a person, strap means extended from said harness means, and line latching means at a free end of said strap means whereby a person overboard equipped with said line latching means may approach said trailing line and interengage said line latching means with said trailing line, thus to apply tension to said trailing line and deploy said sea anchor means.

6. The invention as claimed in claim 1, said emergency rescue system further comprising line latching means carried by a person, whereby a person overboard equipped with said line latching means may approach said trailing line and interengage said line latching means with said trailing line, thus to apply tension to said trailing line and deploy said sea anchor means.

7. The invention as claimed in claim 1, wherein said sea anchor means further comprise trip line means for deactivating said sea anchor, attached thereto and deployed from said vessel upon opening of said container, whereupon after rescue of a person overboard, said trip line means is activated from the vessel underway, thus to render said sea anchor means inoperative and facilitate the recovery of said sea anchor means.

8. The invention as claimed in claim 1, further comprising, in combination, a man overboard accessible reboarding means adjacent the stern of the vessel underway, for use by the person overboard after the person has been towed to the vessel underway by said sea anchor means pulling on the proximal end of said trailing line.

9. The invention as claimed in claim 1, wherein a portion of said trailing line intermediate said free distal end and said pulley means includes means for releasably attaching said trailing line portion to said container means openable closure means housing said sea anchor means and said sea anchor means, whereupon tension being applied to said trailing line by a person overboard, said container means are opened and sea anchor means are deployed free of said container means.

10. The invention as claimed in claim 9, wherein said means for releasably attaching said trailing line to one of said container means openable closure means and said sea anchor means comprise means for retaining said openable closure means normally closed, said trailing line having a mesial operative portion looped through said retaining means, said sea anchor means being configured and arranged so as to open upon opening of said openable closure means, whereupon tension being exerted upon said trailing line, said trailing line looped portion is caused to disengage from said openable closure means, which, in turn, is caused to open by force applied thereagainst from said sea anchor means, thus to deploy said sea anchor means.

11. The invention as claimed in claim 1, further comprising means for affixing said container means adjacent to a stern of the vessel underway.

12. The invention as claimed in claim 11, wherein said container affixing means further comprise selective manually releasable means for securing said container means directly to the transom of a vessel underway.

13. The invention as claimed in claim 11, wherein said container affixing means further comprise means defining a cavity within a transom of a vessel underway, said container means being enclosed in said cavity.

14. The invention as claimed in claim 1, further comprising electrically actuated signaling means operable upon release of said sea anchor means from said container means.

15. The invention as claimed in claim 14, said electrically actuated signaling means further comprising a normally open switch which is closed upon deployment of said sea anchor means, said switch remaining closed after deployment of said sea anchor means.

16. The invention as claimed in claim 14, wherein said signaling means further comprise a time staged, emergency signaling means for sending an alarm in the event said timed staged, emergency signaling means is not deactivated within a predetermined time period.

17. The invention as claimed in claim 14, wherein said signaling means further comprise fuel shutoff means for interrupting fuel supply to the engine of a vessel underway so equipped.

18. The invention as claimed in claim 1, further comprising a trailing line grabber device for use by a person overboard, said grabber device including open slot, line locking means formed therein for insertion of a segment of the trailing line grasped by the person overboard.

19. The invention as claimed in claim 1, said container means further comprising means for mounting said container means in a first attitude ready for use by a person overboard, and in a second attitude for repacking of said sea anchor means after use by a person overboard.

20. The invention as claimed in claim 1, further comprising line storage means for stowage of trailing line not in use.

21. The invention as claimed in claim 20, said line storage means comprising spool means for stowage of line not in use.

22. The invention as claimed in claim 20, said line storage means comprising line storage pack means adjacent said container means for stowage of line not in use.

23. The invention as claimed in claim 1, further comprising trailing line latching means engaging said trailing line intermediate said container means and said trailing line distal end, for preventing inadvertent opening of said openable closure means and subsequent deployment of said sea anchor means.

24. The invention as claimed in claim 1, further comprising line launching means for said trailing line, for containing and launching said trailing line under conditions where the trailing of line from a vessel underway is not desired, the trailing line, once launched by said line launching means, being grasped by a person overboard to thereby cause said closure means to open and said trailing line proximal end and said sea anchor to deploy in the water behind the vessel.

* * * * *